US006525702B1

(12) United States Patent
Van Dijk

(10) Patent No.: US 6,525,702 B1
(45) Date of Patent: Feb. 25, 2003

(54) METHOD OF AND UNIT FOR DISPLAYING AN IMAGE IN SUB-FIELDS

(75) Inventor: Roy Van Dijk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/516,038

(22) Filed: Mar. 1, 2000

(30) Foreign Application Priority Data

Sep. 17, 1999 (EP) ..... 99203050

(51) Int. Cl.[7] ..... G09G 3/28
(52) U.S. Cl. ..... 345/63; 345/77
(58) Field of Search ..... 345/62, 63, 77, 345/600, 601, 596; 348/470

(56) References Cited

U.S. PATENT DOCUMENTS 5,473,384 A * 12/1995 Jayant et al. ..... 348/470
5,841,413 A 11/1998 Zhu et al. ..... 345/63
5,907,316 A * 5/1999 Mikoshiba et al. ..... 345/596
6,064,356 A * 5/2000 Shigeta ..... 345/63
6,097,368 A * 8/2000 Zhu et al. ..... 345/601

* cited by examiner

*Primary Examiner*—Steven Saras
*Assistant Examiner*—Uchendu O. Anyaso
(74) *Attorney, Agent, or Firm*—Edward W. Goodman

(57) ABSTRACT

A display device (600) is driven in a number of sub-fields. Each of the sub-fields is for outputting a respective illumination level by the display device. In each sub-field, a pixel of the displayed image may emit an amount of light corresponding to the particular sub-field, depending on whether it is switched on or not. A required intensity level of the pixel is realized by selecting an appropriate combination of sub-fields in which the pixel is switched on. A plurality of sub-fields is available to realize a particular intensity level. The image display unit (604) has a selection unit (608) that is arranged to select the combination of sub-fields for a particular pixel from a plurality of available combinations in such a way that any artifact is as small as possible. This selection is carried out on the basis of a further pixel in the current image.

8 Claims, 4 Drawing Sheets

METHOD OF AND UNIT FOR DISPLAYING AN IMAGE IN SUB-FIELDS

BACKGROUND OF THE INVENTION

1. Field of the Invention

The invention relates to a method of displaying an image on a display device in a plurality of sub-fields, each sub-field for outputting a respective illumination level by the display device, wherein the image includes a plurality of pixels each having a respective intensity value from a set of intensity values and wherein at least one of these intensity values can be generated by a plurality of combinations of the sub-fields, the method comprising the steps of selecting, for a particular pixel, a combination of sub-fields in conformance with its intensity value, and sending a representation of the selected combination to the display device for displaying the particular pixel.

The invention further relates to an image display unit for displaying an image on a display device in a plurality of sub-fields, each sub-field for outputting a respective illumination level by the display device, wherein the image includes a plurality of pixels each having a respective intensity value from a set of intensity values and wherein at least one of these intensity values is generated by a plurality of combinations of the sub-fields, the image display unit comprising selection means for selecting for a particular pixel, a combination of sub-fields in conformance with its intensity value, and sending means for sending a representation of the selected combination to the display device for displaying the particular pixel.

The invention further relates to an image display apparatus comprising such an image display unit.

2. Description of the Related Art

U.S. Pat. No. 5,841,413 describes a plasma display panel driven in a plurality of sub-fields. A plasma display panel is made up of a number of cells that can be switched on and switched off. A cell corresponds with a pixel (picture element) of the image that is to be displayed on the panel. In the operation of the plasma display panel, three phases can be distinguished. The first phase is the erasure phase in which the memories of all cells of the panel are erased. The second phase is the addressing phase, in which the cells of the panel that are to be switched on are conditioned by setting appropriate voltages on their electrodes. The third phase is the sustain phase, in which sustain pulses are applied to the cells which cause the addressed cells to emit light for the duration of the sustain phase. The plasma display panel only emits light during this sustain phase. The three phases together are called a sub-field period or simply a sub-field. A single image, or frame, is displayed on the panel in a number of successive sub-field periods. A cell may be switched on for one or more of the sub-field periods. The light emitted by a cell in the sub-field periods in which it was switched on, is integrated in the eye of the viewer who perceives a corresponding intensity for that cell. In a particular sub-field period, the sustain phase is maintained for a particular time resulting in a particular illumination level of the activated cells. Typically, different sub-fields have a different duration of their sustain phase. A sub-field is given a coefficient of weight to express its contribution to the light emitted by the panel during the whole frame period. An example is a plasma display panel with 6 sub-fields having coefficients of weight of 1, 2, 4, 8, 16 and 32, respectively. By selecting the appropriate sub-fields in which a cell is switched on, 64 different intensity levels can be realized in displaying an image on this panel. The plasma display panel is then driven by using binary code words of 6 bits each, whereby a code word indicates the intensity level of a pixel in binary form.

In driving a plasma display panel, the frame period, i.e., the period between two successive images, is divided into a number of sub-field periods. During each of these sub-field periods, a cell may or may not be switched on, and the integration over the sub-field periods results in a perceived intensity level of the pixel corresponding with this cell. Instead of displaying a pixel integrally, on a plasma display panel, the pixel is displayed as a series of sub-pixels shifted in time with respect to each other. This may cause artifacts if the eyes of the viewer move. Then, it appears as if the sub-pixels do not originate from a single position and a blurring effect occurs. Furthermore, artifacts may occur in case the images show a moving object. The movement needs to be taken into account when displaying the object in a number of sub-fields. For each next sub-field, the object must be moved a little. Motion compensation techniques are used to calculate a corrected position for the sub-pixels in the sub-fields. In some circumstances, the motion compensation is not fully reliable and may produce erroneous results, e.g., in an area of the image with little detail. The erroneous results lead to motion compensation where this should not be done. This gives so-called motion artifacts which are very visible.

An artifact is most noticeable if two neighboring pixels have a small difference in intensity level while, for one of the pixels, the sub-field with the largest coefficient of weight is on and, for the other of the pixels, this sub-field is off. In case of the example of the binary code above, the code word for one pixel has the most significant bit on and the code word for the other pixel has the most significant bit off. Any error in the calculated position of a sub-field, i.e., any motion artifact involving these pixels, will then give a relatively large artifact in the displayed image. The device described in U.S. Pat. No. 5,841,413 tries to mitigate these artifacts by restricting the code words that are used. This known device employs more sub-fields than necessary for realizing the required set of intensity values. The resulting set of code words for expressing the intensity value is redundant, i.e., for a given intensity value, more than one code word is avaiable. From this redundant set, a subset is created whereby those code words are selected that give the least differences in the most significant bit for expressing a difference between the intensity values. This subset is created by searching the original set and determining what the effect on the artifacts may be for a difference between a given code word and each of the other code words.

SUMMARY OF THE INVENTION

It is an object of the invention to provide a method as described in the preamble with an improved reduction of artifacts. This object is achieved, according to the invention, in a method which is characterized in that the combination of sub-fields for the particular pixel is selected on the basis of the combination of sub-fields selected for at least one other pixel of the image. This makes it possible to select, for the particular pixel, the best combination of sub-fields from among the possible combinations taking into account the actual content of the image to be displayed. The best combination of sub-fields is that one where any occurring artifact is as small as possible. The selection of sub-fields for the particular pixel on the basis of actual content is better than the selection made in the known method, where the combination is selected only on the basis of the comparison of the combinations themselves.

An embodiment of the method according to the invention is characterized in that the combination of sub-fields for the particular pixel is selected to contain the same sub-fields as the combination of sub-fields for the at least one other pixel, such to the extent possible and with preference for the sub-field for outputting the highest illumination level. Hence, any difference between the intensity levels of the particular pixel and the other pixel will be realized as much as possible with sub-fields for the low illumination levels. Therefore, the two combinations will have the same sub-fields for the high illumination levels whenever possible. Or differently phrased, the result is that the most significant bits of the code words representing the pixel intensity values are identical to each other whenever possible. If the sub-fields for the higher values are identical to each other, then any artifact will be caused by a sub-field of lower intensity and will thus be less visible.

An embodiment of the method according to the invention characterized in that the pixels of the image are received in a serial manner and wherein the combination of sub-fields for the particular pixel is selected on the basis of the combination of sub-fields selected for at least one other pixel received prior to the particular pixel. Since the selection of the combination of sub-fields is made on the basis of one or more earlier received and processed pixels, it is not necessary to store the image in a memory for determining the combination of sub-fields. Such a memory would be necessary if the combination of sub-fields for a particular pixel was determined on the basis of a pixel that was not yet received.

An embodiment of the method according to the invention is characterized in that the pixels of the image are organized in a plurality of horizontal lines and wherein the combination of sub-fields for the particular pixel is selected on the basis of the combination of sub-fields selected for the pixel directly preceding the particular pixel on the same horizontal line. Now, only the combination of one pixel needs to be stored for determining the combination of sub-fields for the particular pixel. Furthermore, it is effective to determine the combination of sub-fields on the basis of the combination of the neighboring pixel since artifacts are often caused by errors between neighboring pixels.

An embodiment of the method according to the invention is to characterized in that the pixels of the image are organized in a plurality of horizontal lines and wherein the combination of sub-fields for the particular pixel is selected on the basis of the combination of sub-fields selected for the pixel located at the same position as the particular pixel on the horizontal line directly preceding the horizontal line of the particular pixel. In this embodiment, one horizontal line of the image needs to be stored, making it possible to determine the combination of sub-fields on the basis of the combination of a neighboring pixel on the previous horizontal line. It is effective to determine the combination of sub-fields on the basis of the combination of the neighboring pixel since artifacts are often caused by errors between neighboring pixels. Storing one horizontal line of the image only requires a moderately sized memory.

An embodiment of the method according to the invention is characterized in that the method comprises a step of determining edges of an area comprising the particular pixel and wherein the combination of sub-fields for the particular pixel is selected on the basis of the combination of sub-fields selected for at least one other pixel in that area. By analyzing the pixels of a certain area, it is possible to select that combination of sub-fields that will give the smallest chance on artifacts in that area.

It is a further object of the invention to provide an image display unit as described in the preamble with an improved reduction of artifacts. This object is achieved, according to the invention, in an image display unit which is characterized in that the selection means is arranged to select the combination of sub-fields for the particular pixel on the basis of the combination of sub-fields selected for at least one other pixel of the image. This allows the selection of that combination of sub-fields from the available combinations of sub-fields, which is most suitable regarding the actual content of the current image.

BRIEF DESCRIPTION OF THE DRAWINGS

The invention and its attendant advantages will be further elucidated with the aid of exemplary embodiments and the accompanying schematic drawings, wherein.

DESCRIPTION OF THE PREFERRED EMBODIMENTS

Figure 1:
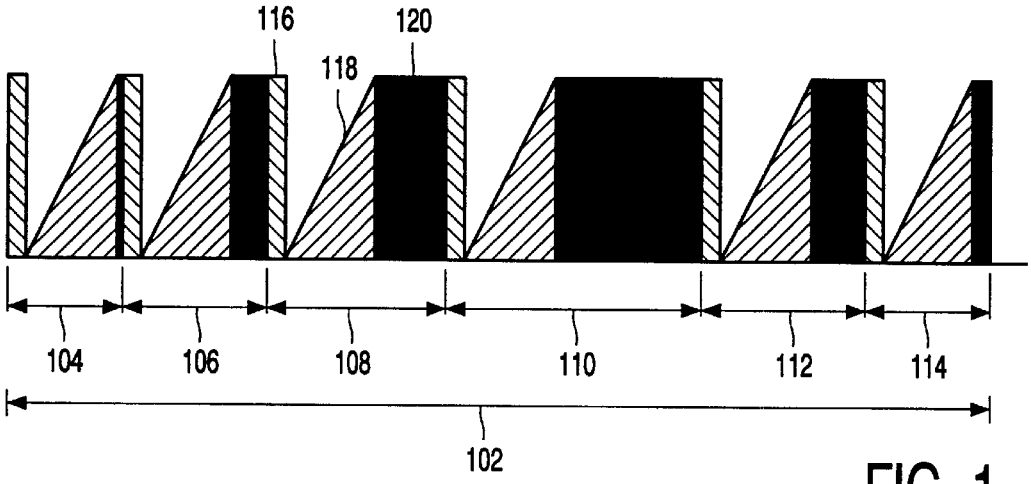
FIG. 1 schematically shows a field period with 6 sub-fields.

FIG. 1 schematically shows a field period with 6 sub-fields. The field period 102, also called the frame period, is the period in which a single image or frame is displayed on the display panel. In this example, the field period 102 consists of 6 sub-fields indicated with references 104–114. In a sub-field, a cell of the display panel may be switched on in order to produce an amount of light. Each sub-field starts with an erasure phase in which the memories of all cells are erased. The next phase in the sub-field is the addressing phase in which the cells that are to be switched on for emitting light in this particular sub-field are conditioned. Then, in a third phase of the sub-field which is called the sustain phase, sustain pulses are applied to the cells. This causes the cells that have been addressed to emit light during the sustain phase. The organization of these phases is shown in FIG. 1, where time runs from left to right. For example sub-field 108 has an erasure phase 116, an addressing phase 118 and a sustain phase 120.

The perceived intensity of a pixel of a displayed image is determined by controlling during which of the sub-fields the cell corresponding to the pixel is switched on. The light emitted during the various sub-fields in which a cell is switched on is integrated in the eyes of the viewer, thus resulting in a certain intensity of the corresponding pixel. A sub-field has a coefficient of weight indicating its relative contribution to the emitted light. An example is a plasma display panel with 6 sub-fields having coefficients of weight of 1, 2, 4, 8, 16 and 32 respectively. By selecting the appropriate combination of sub-fields in which a cell is switched on, 64 different intensity levels can be realized in displaying an image on this panel. The plasma display panel is then driven by using binary code words of 6 bits each, whereby a code word indicates the intensity level of a pixel in binary form.

Figure 2:
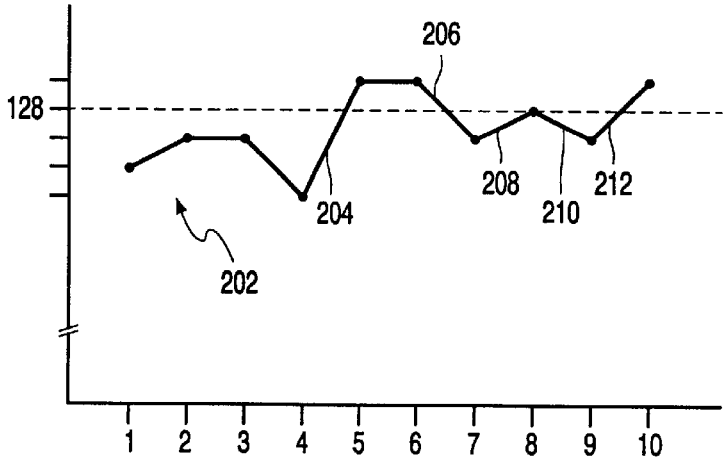
FIG. 2 shows the intensity levels of a series of pixels for a display device using 8 sub-fields.

FIG. 2 shows the intensity levels of a series of pixels for a display device using 8 sub-fields. The series of pixels can be the adjacent pixels on a horizontal or vertical line of the display. However, the series can also be the different intensity values over time of a single position on the display. Trace 202 indicates the intensity value expressed as a code word representing the combination of sub-fields as described above. The trace shows, for example, pixel 1 having an intensity of 126 and pixel 10 having an intensity of 129. The following Table I shows for this series of pixels in which sub-fields the corresponding cell or cells of the display are switched on. The sub-fields SF1, . . . , SF8 have coefficients of weight of 1, 2, 4, 8, 16, 32, 64 and 128, respectively.

TABLE I

Combinations of sub-fields for intensity levels of the series of pixels

| | intensity | SF1 | SF2 | SF3 | SF4 | SF5 | SF6 | SF7 | SF8 |
|---|---|---|---|---|---|---|---|---|---|
| 1 | 126 | | x | x | x | x | x | x | |
| 2 | 127 | x | x | x | x | x | x | x | |
| 3 | 127 | x | x | x | x | x | x | x | |
| 4 | 125 | x | | x | x | x | x | x | |
| 5 | 129 | x | | | | | | | x |
| 6 | 129 | x | | | | | | | x |
| 7 | 127 | x | x | x | x | x | x | x | |
| 8 | 128 | | | | | | | | x |
| 9 | 127 | x | x | x | x | x | x | x | |
| 10 | 129 | x | | | | | | | x |

This Table shows, for example that for pixel 2 with an intensity level of 127, all sub-fields but sub-field SF8 are to be used.

A transition from one intensity to a different intensity is realized by using a different combination of sub-fields. For some transitions, a small change in intensity has to be realized by a change in sub-field SF8, the sub-field generating the largest amount of light. These are transitions 204, 206, 208, 210 and 212 in FIG. 2. Artifacts related to the pixels involved in such transitions are more noticeable than others since they concern the sub-fields producing a relatively large part of the light.

In an embodiment of the invention, the display device with originally 8 sub-fields is now operated with an extended $9^{th}$ sub-field. The organization of the original 8 sub-fields with their particular coefficients remains the same. The extended sub-field is given a relatively small coefficient of weight. The purpose of the extended sub-field is to provide for more than one combination of sub-fields for realizing a desired intensity level. Then, a suitable combination can be selected that avoids the problematic transitions described above. In this embodiment, the $9^{th}$ sub-field has a coefficient of weight of 12. Table II below shows how the intensity levels according to FIG. 2 can be realized using the 9 sub-fields.

TABLE II

Combinations for intensity levels of the series of pixels using 9 sub-fields

| | intensity | SF1 | SF2 | SF3 | SF4 | SF5 | SF6 | SF7 | SF8 | SF9 |
|---|---|---|---|---|---|---|---|---|---|---|
| 1 | 126 | | x | x | x | x | x | x | | |
| 2 | 127 | x | x | x | x | x | x | x | | |
| 3 | 127 | x | x | x | x | x | x | x | | |
| 4 | 125 | x | | x | x | x | x | x | | |
| 5 | 129 | x | | x | | x | x | x | | x |
| 6 | 129 | x | | x | | x | x | x | | x |
| 7 | 127 | x | x | x | x | x | x | x | | |
| 8 | 128 | | | x | | x | x | x | | x |
| 9 | 127 | x | x | x | x | x | x | x | | |
| 10 | 129 | x | | x | | x | x | x | | x |

Now, all above intensity levels can be realized without activation of sub-field SF8, the sub-field with the highest contribution to the production of light. This can be done by instead using sub-field SF9 instead, with a proper combination of lower sub-fields. Now, none of the transitions above involve switching between sub-field SF8 since, for none of the intensity levels, sub-field SF8 is necessary. In general, for realizing increasing intensity levels the usage of sub-field SF8 is postponed as long as possible by first using the extended sub-field SF9, which has a smaller coefficient of weight. Only when the intensity level can no longer be realized without it, sub-field SF8 is used in the combination of sub-fields. Once it has been used, switching it off is postponed as long as possible. So sub-field SF8 will then be used for the subsequent pixel if this is possible. Maintaining the usage of sub-field SF8 is done in order to minimize the number of critical transitions where sub-field SF8 is on in one pixel and off in the next.

Figure 3:
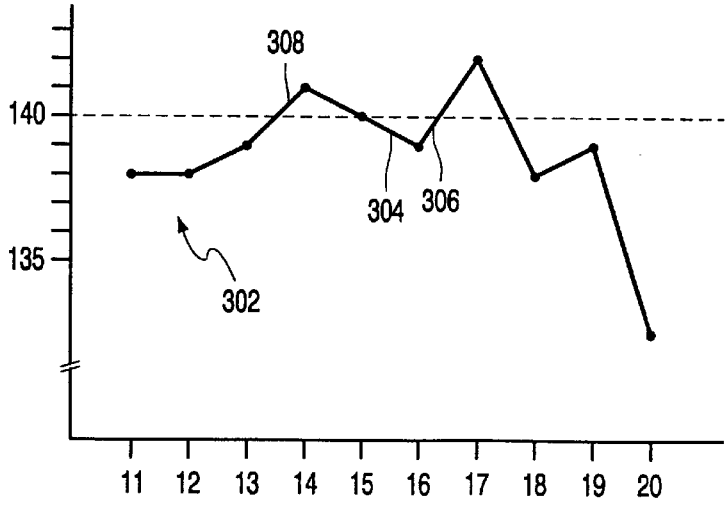
FIG. 3 shows the usage of the extended sub-field.

FIG. 3 shows the usage of the extended sub-field. Trace 302 represents the intensity levels for a further series of pixels 11 to 20. The intensity levels for pixels 11, 12 and 13 are realized without the highest sub-field SF8. For all further pixels, sub-field SF8 is used, including for further pixels which could be realized without sub-field SF8, like pixel 16. The sub-field SF8 is used for pixel 16 to avoid that transitions 304 and 306 become a critical transition involving a change in sub-field SF8. Table III below shows the realizations of the intensity levels for the series of pixels.

TABLE III

Combinations for intensity levels of the series of pixels using 9 sub-fields

| | intensity | SF1 | SF2 | SF3 | SF4 | SF5 | SF6 | SF7 | SF8 | SF9 |
|---|---|---|---|---|---|---|---|---|---|---|
| 11 | 138 | | x | x | x | x | x | x | | x |
| 12 | 138 | | x | x | x | x | x | x | | x |

TABLE III-continued

| | Combinations for intensity levels of the series of pixels using 9 sub-fields | | | | | | | | | |
|---|---|---|---|---|---|---|---|---|---|---|
| | intensity | SF1 | SF2 | SF3 | SF4 | SF5 | SF6 | SF7 | SF8 | SF9 |
| 13 | 139 | x | x | x | x | x | x | x | | x |
| 14 | 141 | x | | x | x | | | | x | |
| 15 | 140 | | | x | x | | | | x | |
| 16 | 139 | x | x | | x | | | | x | |
| 17 | 142 | | x | x | x | | | | x | |
| 18 | 138 | | x | | x | | | | x | |
| 19 | 139 | x | x | | x | | | | x | |
| 20 | 132 | | | x | | | | | x | |

The sub-fields have been selected into such combinations that the number of critical transitions is minimal. Only transition 308 between pixel 13 and pixel 14 is critical because for pixel 13, sub-field SF8 is off, while for pixel 14, sub-field SF8 is on.

In the examples shown above, the extended sub-field has a value of 12 and has been used to avoid unnecessary transitions of the sub-fields SF8 which has a value of 128. As described earlier, for mitigating the visible artifacts it is better to switch between sub-fields with a small value than between sub-fields with a large value. Therefore, the extended sub-field can not only be used to avoid transitions of SF8 but also for transitions of sub-fields that have a value larger than the value of the extended sub-fields, e.g., SF7 and SF6.

Figure 4:
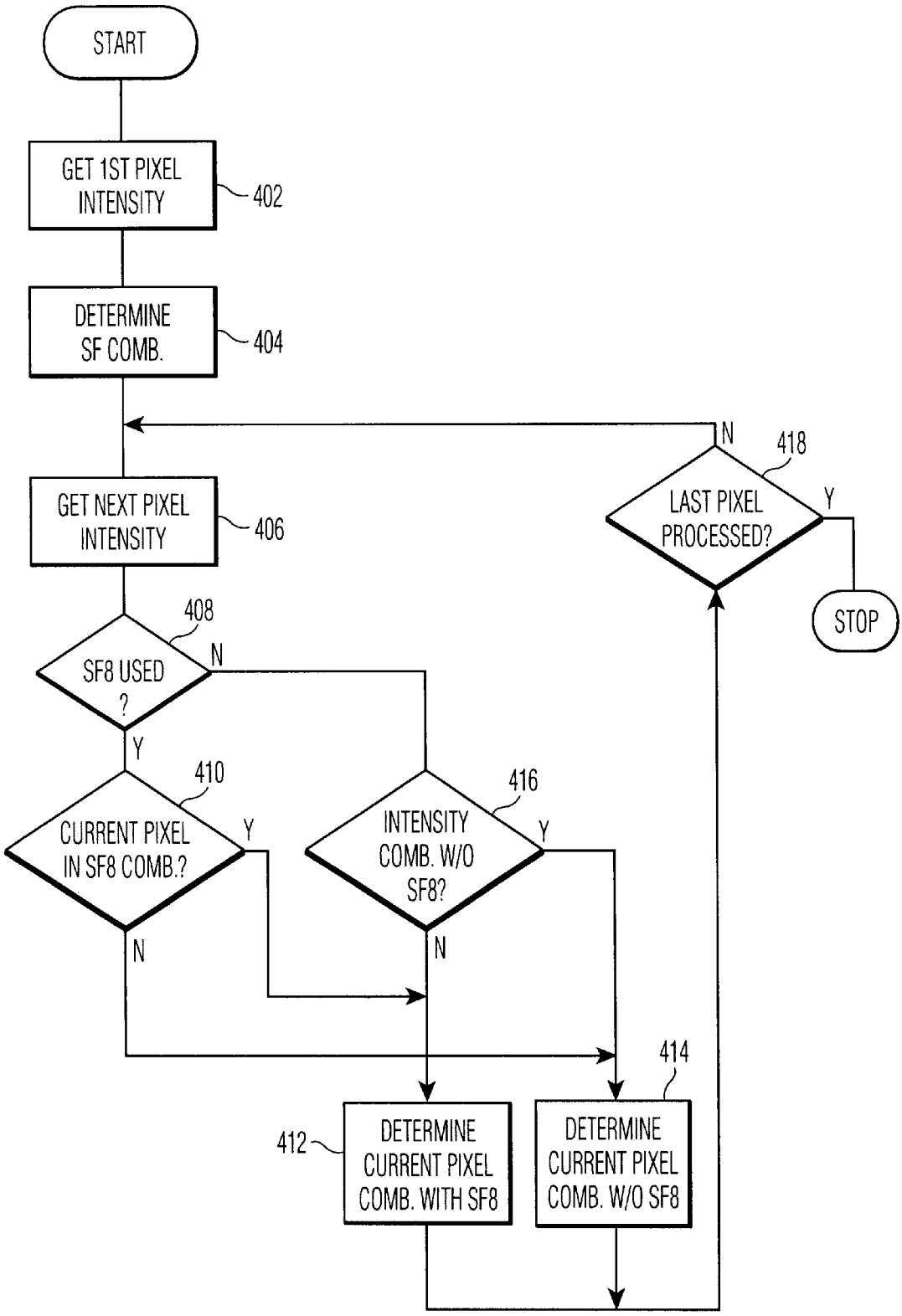
FIG. 4 is a flowchart illustrating the method of selecting the sub-field combinations.

FIG. 4 is a flowchart illustrating the method of selecting the sub-field combinations. When selecting a sub-field combination, a choice must be made whether the original sub-field distribution with sub-fields SF1 to SF8 is used or whether the extended distribution using the extended sub-field SF9 as well is used. In step 402, the intensity level of the first pixel is obtained and, in step 404 the original sub-field distribution is used to determine the sub-field combination. Then, in step 406 the intensity level of the next pixel is obtained. The combination of sub-fields that should be selected for this pixel depends on whether or not the most significant sub-field SF8 has been used for the previous pixel. Therefore, it is checked in, step 408 whether SF8 has been used for the previous pixel. If this is the case, then it is checked in, step 410 whether the intensity value of the current pixel can be realized with a combination of sub-fields where SF8 is also used. If this is the case, the a combination of sub-fields for the current pixel is determined in, step 412 using SF8. If this is not the case, the a combination of sub-fields for the current pixel is determined, in step 414 where SF8 is not used. If it has been established, in step 408 that SF8 has not been used for the previous pixel, then it is checked, in step 416 whether the intensity value of the current pixel can be realized with a combination of sub-fields where SF8 is also not used. If this is the case, then execution continues at step 414, where a combination of sub-fields for the current pixel is determined where SF8 is not used, and otherwise execution continues at step 414, where a combination of sub-fields for the current pixel is determined where SF8 is used. Finally, after a combination of sub-fields for the current pixels has been determined, it is checked, in step 418, whether the last pixel has been processed. If this is not the case, then execution continues at step 406 for the next pixel and otherwise the execution stops.

Figure 5:
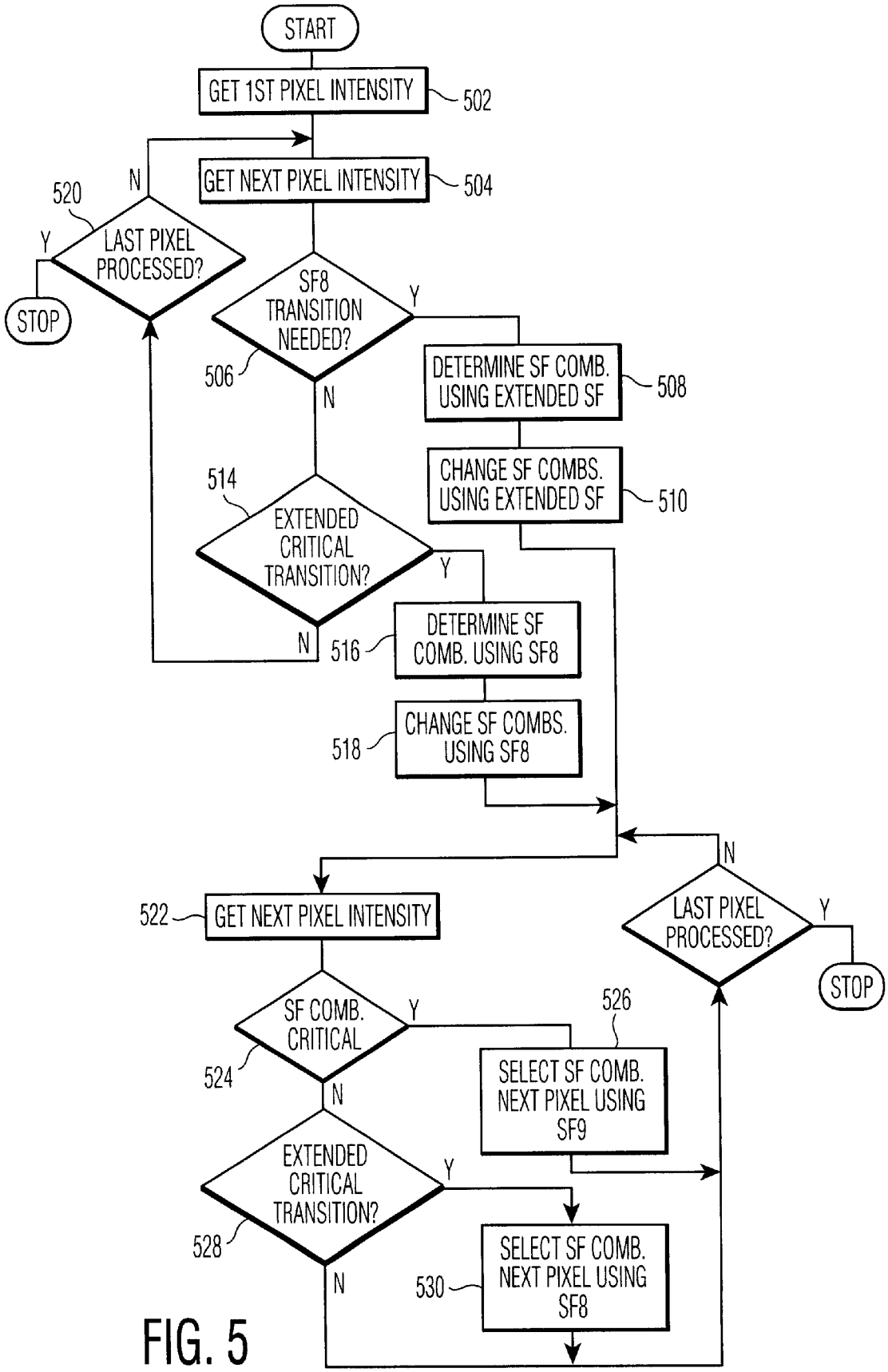
FIG. 5 is a flowchart illustrating an alternative method of selecting the sub-field combinations.

FIG. 5 is a flowchart illustrating an alternative method of selecting the sub-field combinations. In this embodiment, an entire line of pixels is evaluated for the presence of critical transitions and for extended critical transitions. If only critical transitions are present, then the extended sub-field is used. If only extended critical transitions are present, then the sub-field SF8 is used without using the extended sub-field. If both types of critical transition are present, then the first one on the line is used for choosing the sub-field combination at that point. In step 502, the intensity level for the first pixel is obtained and the sub-field combination for this pixel is determined using the original sub-field distribution. Then, in step 504, the intensity level for the next pixel is obtained and, in step 506 it is determined whether a transition of SF8 would necessary. If this is the case, then, in step 508 the sub-field combination for this pixel is determined using the extended sub-field and, in step 510 the sub-field combinations for the pixels determined so far are changed to using the extended sub-field as well. Then execution continues to process the remaining pixels of the line. If in step 506 it is determined that for this pixel no critical transition is involved, then it is determined, in step 514, whether an extended critical transition is involved. If this is the case, then, in step 516 a sub-field combination for this pixel is determined using sub-field SF8 and, in step 518 the sub-field combinations for the pixels determined so far are changed to using sub-field SF8 as well. The execution continues to process the remaining pixels of the line. If no extended critical transition is determined, then it is checked, in step 520 whether the last pixel of the line has been processed and if this is not so, the next pixel is processed in a next loop of steps starting at step 504.

Processing the remaining pixels of the line continues in step 522, where the intensity level of the next pixel is obtained. In step 524, it is determined whether the sub-field combination for this next pixel would be critical, i.e., whether a transition of sub-field SF8 would be necessary. If that is the case, then, in step 526 a sub-field combination for the next pixel is selected using the extended sub-field SF9. If, in step 524, it is determined that there would be no transition of sub-field SF8, then in, step 528 it is determined whether there would be an extended critical transition. If this is the case, then, in step 530 a sub-field combination for the next pixel is selected using SF8. Finally, in step 532, it is checked whether the last pixel has been processed. If this is not the case, then the execution is continued, at step 522 for the next pixel and otherwise the execution stops.

The line of pixels in the alternative method may be a vertical line of the image or a horizontal line. If a horizontal line is used, then only a memory for the pixels of a single horizontal line would be necessary. A further alternative method is the combination of the two alternative methods described above. The method described in connection with FIG. 4 is used for the vertical direction and the method described in connection with FIG. 5 is used in the horizontal direction.

A further alternative is to analyze the pixels of a complete area of the image. In a first step, the area is detected by means of an edge detection algorithm, and the pixels in that area are identified. Then, the combinations of sub-fields for these pixels are determined using the same technique as for the line of pixels above.

The method of using an extended sub-field can advantageously be used for displaying an area of the image that contains few details. Artifacts can easily occur in such an area, e.g., when the motion estimator provides inaccurate results. The extended sub-field can then be used to avoid transition of the most significant sub-field, thus, mitigating the artifacts. The choice of the coefficient of weight for the extended sub-field is a compromise. A large coefficient of weight for the extended sub-field gives a large range over which critical transitions can be avoided. However, the application of the extended sub-field is limited to the transitions of sub-fields that have a larger coefficient of weight than the extended sub-fields. That makes it desirable to choose a small coefficient of weight. The coefficient of weight of 12 given in the examples above appeared a good compromise.

Furthermore, it is possible to analyze the image and to adapt the coefficient of weights to the actual image. This is then done in such a way that as few critical transitions as possible occur, a critical transition beings a transition involving sub-fields with a larger coefficient of weight. Also the coefficient of weight of the extended sub-field can be chosen on the basis of this analysis of the image.

Figure 6:
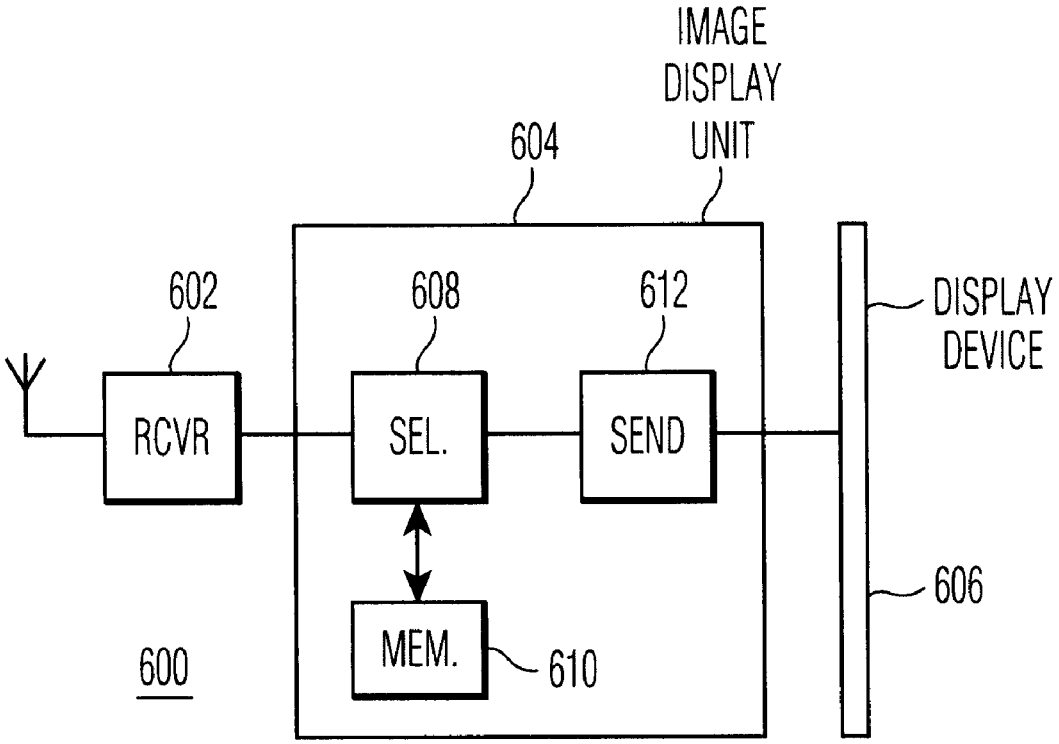
FIG. 6 shows the most important elements of an image display apparatus according to the invention.

FIG. 6 shows the most important elements of an image display apparatus according to the invention. The image display apparatus 600 has receiving means 602 for receiving a signal representing the image to be displayed. This signal may be a broadcast signal received via an antenna or cable but may also be a signal from a storage device like a VCR (Video Cassette Recorder). The image display apparatus 600 further has an image display unit 604 for processing the image, and a display device 606 for displaying the processed image. The display device 606 is of a type that is driven in sub-fields. The image display unit has selection means 608 for selecting the appropriate combination of sub-fields for each of the pixels of the image. The selection means uses a memory 610 where one or more pixels and their combinations of sub-fields are for carrying out those alternative methods described above that require storing one or more pixels. Furthermore, the image display unit has a sending means 612 for sending the representations of sub-field combinations of the pixels to the display device 606.

The invention has been described for an image composed of pixels each having a certain intensity level. The invention can be applied to black and white images and to color images. In a color image, a pixels has a separate intensity level for each color that is used. The determination of the combination of sub-fields according to the invention is then carried out for each of the colors. In case of the traditional RGB (Red, Green and Blue) representation of a color image, 3 combinations of sub-fields are determined according to the invention.

It should be noted that the above-mentioned embodiments illustrate rather than limit the invention and that those skilled in the art will be able to design many alternative embodiments without departing from the scope of the appended claims. The word 'comprising' does not exclude the presence of elements or steps other a claim. The word "a" or "an" preceding an element does not exclude the presence of a plurality of such elements. The invention can be implemented by means of hardware comprising several distinct elements and by means of a suitably programmed computer. In the unit claims enumerating several means, several of these means can be embodied by one and the same item of hardware.

What is claimed is:

1. A method of displaying an image on a display device in a plurality of sub-fields, each sub-field causing the display device to output a respective illumination level, wherein the image includes a plurality of pixels each having a respective intensity value from a set of intensity values, and wherein at least one of these intensity values is generated by a plurality of combinations of the sub-fields, the method comprising the steps:

selecting, for a particular pixel, a combination of sub-fields in conformance with its intensity value; and sending a representation of the selected combination to the display device for displaying the particular pixel, characterized in that in said selecting step, the combination of sub-fields for the particular pixel is selected on the basis of the combination of sub-fields selected for at least one other pixel of the image, for minimizing artifacts in the displayed image, and the combination of sub-fields for the particular pixel is selected to contain the same sub-fields as the combination of sub-fields for the at least one other pixel, such to the extent possible and with preference for the sub-field for outputting the highest illumination level.

2. The method as claimed in claim 1, wherein the pixels of the image are received in a serial manner, and wherein, in said selecting step, the combination of sub-fields for the particular pixel is selected on the basis of the combination of sub-fields selected for at least one other pixel received prior to the particular pixel.

3. The method as claimed in claim 2, wherein the pixels of the image are organized in a plurality of horizontal lines, and wherein, in said selecting step, the combination of sub-fields for the particular pixel is selected on the basis of the combination of sub-fields selected for the pixel directly preceding the particular pixel on the same horizontal line.

4. The method as claimed in claim 2, wherein the pixels of the image are organized in a plurality of horizontal lines, and wherein, in said selecting step, the combination of sub-fields for the particular pixel is selected on the basis of the combination of sub-fields selected for the pixel located at the same position as the particular pixel on the horizontal line directly preceding the horizontal line of the particular pixel.

5. The method as claimed in claim 1, wherein the method further comprises the step:

determining edges of an area comprising the particular pixel, and wherein, in the selecting step, the combination of sub-fields for the particular pixel is selected on the basis of the combination of sub-fields selected for at least one other pixel in the determined area.

6. An image display unit for displaying an image on a display device in a plurality of sub-fields, each sub-field causing the display device to output a respective illumination level, wherein the image includes a plurality of pixels each having a respective intensity value from a set of intensity values, and wherein at least one of these intensity values can be generated by a plurality of combinations of the sub-fields, the image display unit comprising:

selection means for selecting, for a particular pixel, a combination of sub-fields in conformance with its intensity value; and sending means for sending a representation of the selected combination to the display device for displaying the particular pixel, characterized in that the selection means selects the combination of sub-fields for the particular pixel on the basis of the combination of sub-fields selected for at least one other pixel of the image, for minimizing artifacts in the displayed image, and the selection means selects the combination of sub-fields for the particular pixel to contain the same sub-fields as the combination of sub-fields for the at least one other pixel, such to the extent possible and with preference for the sub-field for the highest illumination level.

7. The image display unit as claimed in claim 6, wherein said image display unit comprises means for receiving the pixels of the image in a serial manner, while the pixels of the image are organized in a plurality of horizontal lines, and wherein the selection means selects the combination of sub-fields for the particular pixel on the basis of the combination of sub-fields selected for the pixel directly preceding the particular pixel on the same horizontal line.

8. An image display apparatus for displaying an image, comprising:

receiving means for receiving a signal representing the image;

an image display unit as claimed in claim 6; and a display device for displaying the image.

* * * * *